US007765818B2

(12) United States Patent
Buck

(10) Patent No.: US 7,765,818 B2
(45) Date of Patent: Aug. 3, 2010

(54) REFRIGERATION UNIT AND DIAGNOSTIC METHOD THEREFOR

(75) Inventor: Gilbert Walter Buck, Mission Viejo, CA (US)

(73) Assignee: B/E Aerospace, Inc., Wellington, FL (US)

( * ) Notice: Subject to any disclaimer, the term of this patent is extended or adjusted under 35 U.S.C. 154(b) by 1040 days.

(21) Appl. No.: 11/443,557

(22) Filed: May 30, 2006

(65) Prior Publication Data

US 2007/0277538 A1 Dec. 6, 2007

(51) Int. Cl.

| | |
|---|---|
| ***F25B 49/00*** | (2006.01) |
| ***F25B 41/00*** | (2006.01) |
| ***F25B 19/00*** | (2006.01) |
| ***G01K 13/00*** | (2006.01) |
| ***F25D 21/06*** | (2006.01) |
| ***F25D 21/02*** | (2006.01) |
| ***G05D 23/32*** | (2006.01) |

(52) U.S. Cl. ..... 62/180; 62/131; 62/155; 62/157; 62/158; 62/231; 62/125; 62/126; 62/127; 62/128; 62/129; 62/130; 62/203

(58) Field of Classification Search ..... 62/125, 62/126, 127, 128, 129, 130, 131, 157, 203, 62/231

See application file for complete search history.

(56) References Cited

U.S. PATENT DOCUMENTS

| | | | | |
|---|---|---|---|---|
| 3,815,378 A | | 6/1974 | Hoenisch | |
| 4,178,767 A | * | 12/1979 | Shaw | 62/155 |
| 4,325,223 A | * | 4/1982 | Cantley | 62/126 |
| 4,327,557 A | | 5/1982 | Clarke et al. | |
| 4,776,182 A | | 10/1988 | Gidseg | |
| 4,890,459 A | * | 1/1990 | Havemann | 62/126 |
| 5,003,786 A | | 4/1991 | Fudono et al. | |
| 5,255,529 A | * | 10/1993 | Powell et al. | 62/180 |
| 5,303,561 A | | 4/1994 | Bahel et al. | |
| 6,223,817 B1 | * | 5/2001 | Oden et al. | 165/232 |
| 6,691,524 B2 | | 2/2004 | Brooke | |
| 2006/0032379 A1 | * | 2/2006 | Kates | 96/417 |

FOREIGN PATENT DOCUMENTS

JP 10-197109 A 7/1998

* cited by examiner

*Primary Examiner*—Thomas E Denion
*Assistant Examiner*—Michael Carton
(74) *Attorney, Agent, or Firm*—Drinker Biddle & Reath LLP

(57) ABSTRACT

A refrigeration unit and diagnostic method therefore are provided. The refrigeration unit includes: a housing with an insulated cavity for storing food and beverages; a vapor cycle system operative to cool the food and beverages in the insulated cavity; a plurality of sensors in communication with the vapor cycle system and outputting data relative to the vapor cycle system; and a controller that, according to the data from the plurality of sensors, determines an occurrence of an event. Wherein the controller logs the data from the plurality of sensors to a data structure according to a first data-logging mode, and logs the data to the data structure according to a second data-logging mode upon occurrence of the event. In one embodiment the refrigeration unit may be a refrigeration line replaceable unit (LRU) configured for an aircraft galley.

20 Claims, 4 Drawing Sheets

REFRIGERATION UNIT AND DIAGNOSTIC METHOD THEREFOR

FIELD OF THE INVENTION

This invention pertains generally to refrigeration units and more particularly to a chiller/refrigerator/freezer unit for an aircraft galley and a diagnostic method therefore.

BACKGROUND OF THE INVENTION

For operators of passenger vehicles, it is of utmost importance to minimize maintenance costs and downtime. To this end, passenger vehicle components and subsystems are modularized to facilitate replacement. In aircraft, to enable operators to quickly and easily remove and replace faulty, broken or otherwise malfunctioning parts, many components are installed during assembly as line replaceable units (LRUs). Typically, LRUs are removed and replaced by the operator's maintenance staff (and often at the LRU manufacturer's cost, for example, if the LRU is under warranty) at the first indication of irregular operation regardless of whether the LRU has truly malfunctioned. Often, a normally-operating LRU is replaced unnecessarily because the LRU simply has an appearance or isolated instance of irregular operation, for example due to user error in operating the LRU.

One such aircraft LRU that has been replaced unnecessarily is the combination chiller/refrigerator/freezer unit (hereinafter referred to as a refrigeration unit) that is installed in the aircraft's galley. Conventional refrigeration units are user-settable for a temperature set-point. In some instances, however, aircraft staff (e.g., inexperienced flight attendants) may mis-set the temperature set-point relative to the type of items being stored in the refrigeration unit, thereby causing item spoilage. In yet other instances, aircraft staff may close the door to the refrigeration unit but fail to notice that the door was not properly closed and, therefore, the refrigeration unit may operate inefficiently and not properly cool the items being stored inside. In view of the foregoing, a refrigeration unit including a diagnostic means for discriminating between user error and unit malfunction would be an important improvement in the art.

BRIEF SUMMARY OF THE INVENTION

In one aspect, a refrigeration unit is provided. The refrigeration unit includes: a housing including an insulated cavity configured to store food and beverages; a vapor cycle system disposed in the housing, the vapor cycle system operative to cool the food and beverages in the insulated cavity; a plurality of sensors disposed in the housing, the plurality of sensors in communication with the vapor cycle system and outputting data relative to the vapor cycle system; and a controller disposed in the housing, the controller, according to the data from the plurality of sensors, determining an occurrence of an event and outputting control signals to the vapor cycle system. Furthermore, the controller logs the data from the plurality of sensors to a data structure in a first logging mode, for example, at a first rate, and, upon occurrence of the event, logs the data to the data structure in a second logging mode, for example, instantaneously at the event occurrence or at a second rate. In one embodiment, the refrigeration unit may be a refrigeration line replaceable unit (LRU) configured for an aircraft galley.

In another aspect, a diagnostic method is provided for a refrigeration unit including a plurality of sensors and a controller. The method includes the steps of: receiving data from the plurality of sensors; determining an occurrence of an event relative to the data received from the plurality of sensors; if an event has not occurred, the controller operating in a first logging mode and storing the data to a data structure at a first rate; and if an event has occurred, the controller operating in a second logging mode and storing the data to the data structure instantaneously or at a rate different from the normal rate. The step of determining an occurrence of an event may further comprise steps of: detecting a warning event; detecting a fault event; and detecting an informational event.

DETAILED DESCRIPTION OF THE EMBODIMENTS

Figure 1:
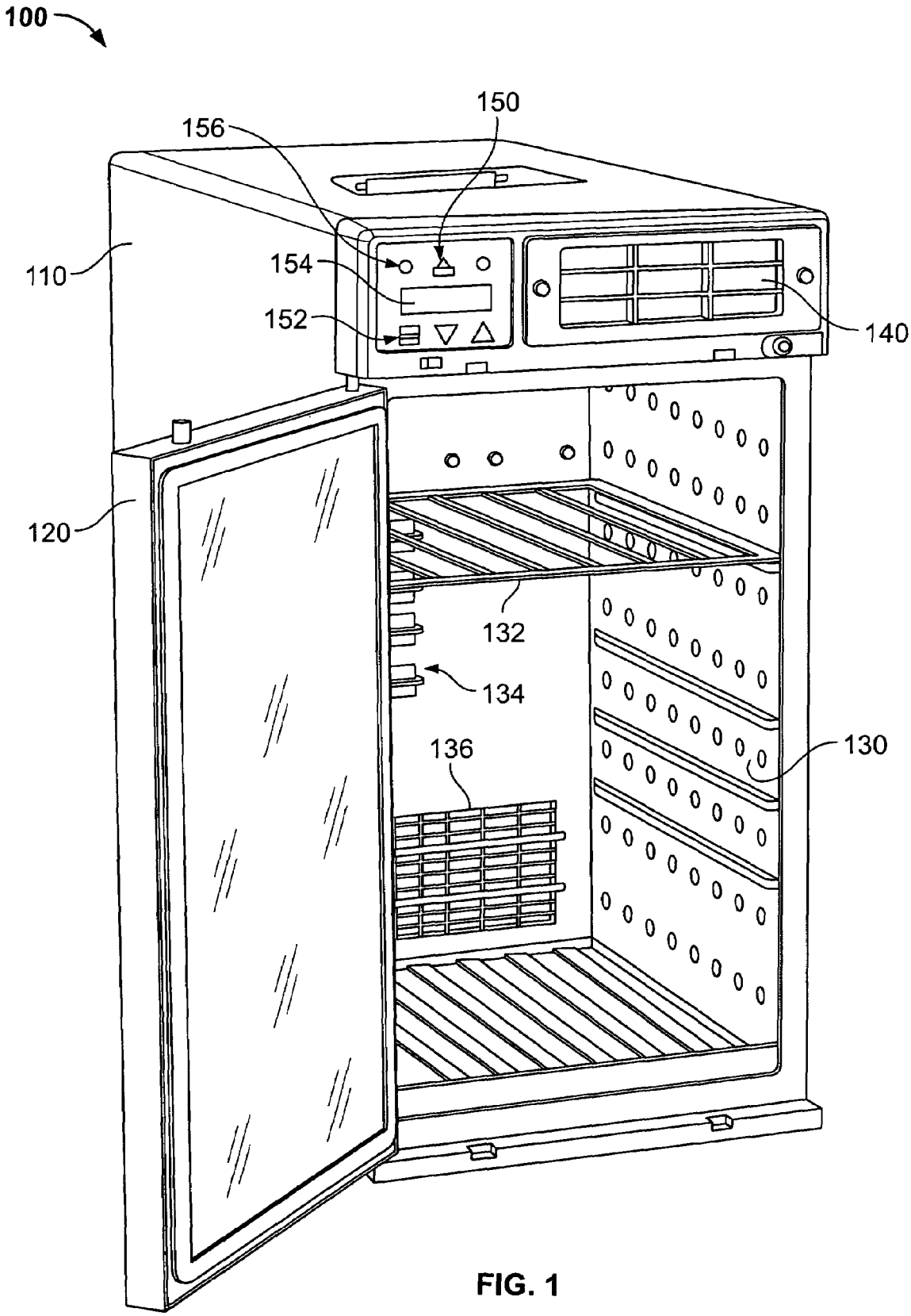
FIG. 1 is a front perspective view of an embodiment of a refrigeration unit.

Referring now to the Figures, a refrigeration unit and a diagnostic method therefore are provided. As shown in FIG. 1, an example refrigeration unit 100 includes a housing 110, a door 120 that is coupled with the housing 110 for movement between a closed orientation and an open orientation, an insulated cavity 130 within the housing 110 for storing items (e.g., food and beverages) to be refrigerated, an air intake 140 and a user interface 150. The refrigeration unit 100 is a self-contained, stand-alone refrigeration unit that chills air for the purpose of maintaining food and beverage items at proper storage temperatures within the insulated cavity 130. As shown, the housing 110 has a generally compact, rectangular polyhedron shape to facilitate installation of the refrigeration unit 100 in a galley of an aircraft, but the housing 110 may be configured in other shapes for installation in other vehicles and locations, for example, busses, trains, vans, residences and offices. The door 120 is coupled with the housing 110 for example by a hinge to move between an open orientation (shown in FIG. 1) wherein the insulated cavity 130 is exposed for accessing items therein and a closed orientation wherein the insulated cavity 130 is sealed. The refrigeration unit 100 may include a knob, handle or the like (not illustrated) that is configured on the door 120 or on the housing 110 for closing/latching/locking and opening/unlatching/unlocking the door 120. For example, aircraft personnel may operate the knob, handle or the like to secure the door 120 in the closed orientation for safety during aircraft takeoff and landing and instances of turbulence.

The insulated cavity 130 is configured to store passenger food and beverages. For example, the insulated cavity 130 may have a volume of about 1.0 cubic feet such that the insulated cavity 130 can accommodate 12 standard wine bottles—9 standing upright on the floor of the insulated cavity and 3 lying on a shelf 132 shown in FIG. 1. The shelf 132 may be used for supporting and organizing items in the insulated cavity 130, but is not required. As shown, the shelf 132 is configured as an open array of wires or bars so as not to obstruct airflow in the insulated cavity 130. However, the shelf 132 may be configured otherwise, for example as a solid planar member. The shelf 132 may be removable and reconfigurable in the insulated cavity 130. That is, the shelf 132 may be removed and reinstalled in the insulated cavity 130 at a different height above the floor of the insulated cavity 130. Although one shelf 132 is illustrated, fewer or additional shelves may be provided as desired. As shown, grills or registers 134 and 136 are configured on a back wall of the insulated cavity 130. Herein, grill 134 supplies refrigerated air to the insulated cavity 130 while grill 136 provides a return for air that has flowed through the insulated cavity 130 and cooled the items therein. However, of course, the grills 134, 136 could be configured oppositely so that grill 136 supplies refrigerated air and grill 134 provides a return. Ambient temperature air is received by the air intake 140 that is configured on a front of the housing 110. The ambient temperature air from the air intake 140 flows into the refrigeration system, which will be discussed hereinafter in detail, to be cooled and then circulates in the insulated cavity 130 via grills 134 and 136.

As further shown in FIG. 1, the refrigeration unit 100 includes a user interface 150. The user interface 150 is illustrated as being configured on the front of the housing 110 proximate the air inlet 140, but the user interface 150 may be configured otherwise. As shown, the user interface 150 includes one or more user-manipulable actuators 152, a display 154 and one or more indicators 156. The actuators 152 may be various devices known in the art such as, buttons (e.g., snap-domes), switches (e.g., microswitches), dials, etc. for outputting a signal to, for example, a controller for controlling/varying operation of the refrigeration unit 100 and requesting information. The display 154 may be various devices known in the art such as, an LCD panel, an LED array, etc. for displaying alphanumeric or other indicia relative to operation of the refrigeration unit 100. The one or more indicators 156 may provide one or more visual and/or audible warnings or alerts that the refrigeration unit 100 is not operating properly. For example, the indicators 156 may be embodied as one or more lights such as LEDs and/or a speaker, buzzer or the like for outputting a sound. In one embodiment, the one or more indicators 156 include a green light to indicate normal operation, a red light to indicate that the refrigeration unit has a failure or fault, and an amber light to indicate that the temperature within the internal cavity differs from the user-selected temperature set-point. Via the user interface 150, a user may select a mode of operation (e.g., chiller, refrigerator, freezer) for the refrigeration unit 100, select or otherwise determine a temperature set-point for the insulated cavity 130, and request information (e.g., number of hours operating, number of defrosts, number of failures, etc.) relative to the current and historical operation of the refrigeration unit 100 and one or more various components and subsystems therein.

Figure 2:
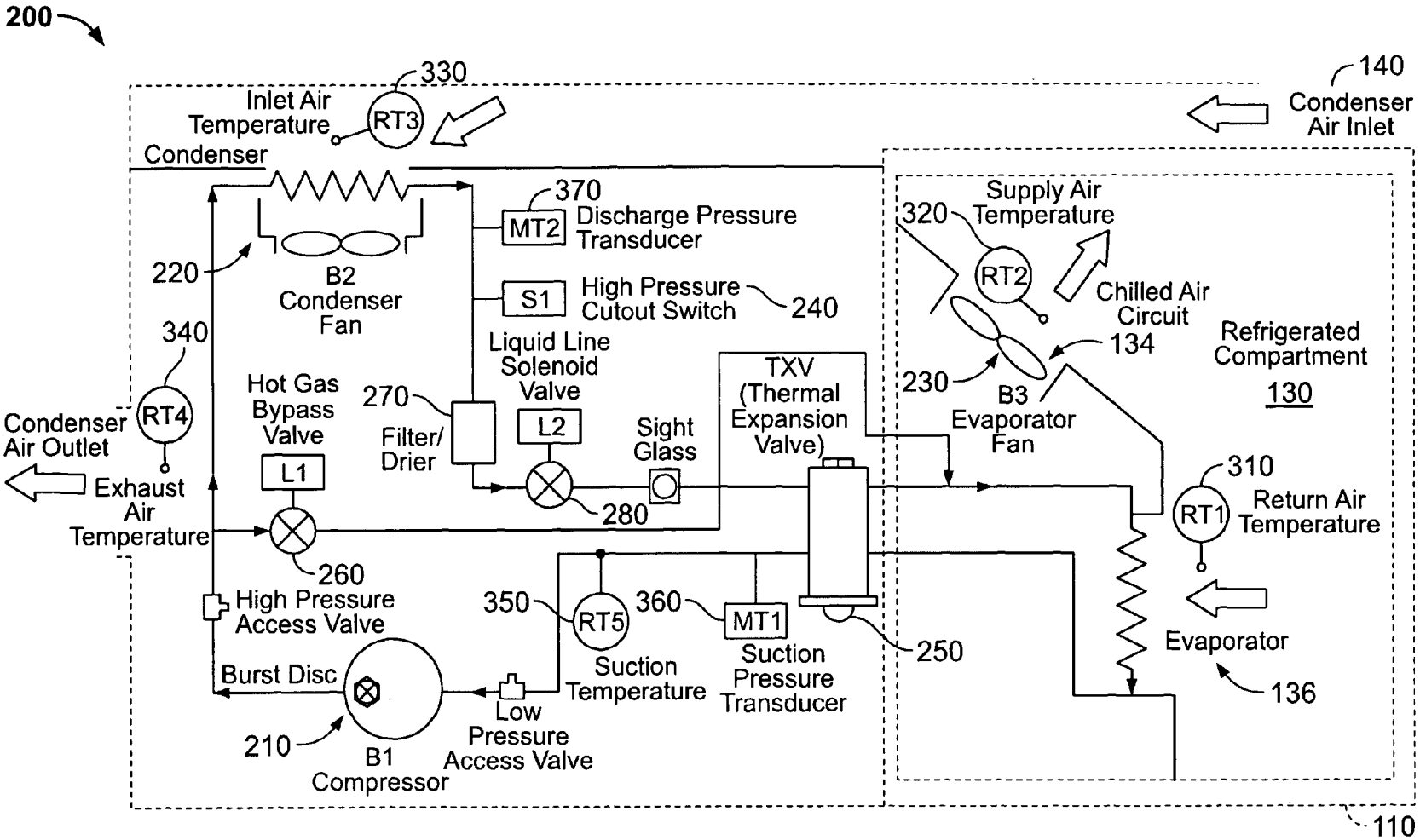
FIG. 2 is a diagrammatic view illustrating an example refrigeration system for the embodiment of FIG. 1.

Referring now to FIG. 2, an example refrigeration system for the refrigeration unit 100 of FIG. 1 is described. As shown in FIG. 2, a refrigeration system 200 is disposed within the housing 110, which is illustrated diagrammatically in dashed lines. Airflow through the refrigeration system 200 is illustrated by the large arrows. The refrigeration system 200 includes various refrigeration components and a plurality of sensors in communication with the refrigeration components for monitoring and controlling operation of the refrigeration system 200. As shown, the refrigeration components of the refrigeration system 200 include a compressor unit 210, a condenser unit 220, an evaporator unit 230, a high pressure cutout switch 240, a thermal expansion valve 250, a hot gas bypass valve 260, a filter/drier unit 270 and a liquid line solenoid valve 280. The compressor unit 210 includes a motor (not shown), for example, a DC motor. Furthermore, the condenser unit 220 and the evaporator unit 230 each includes a motor (not shown), for example, DC motors for rotating fan blades to move air over a condenser and an evaporator heat exchanger, respectively. As known in the art, the refrigeration system 200 is a Vapor Cycle system (VCS) that provides the transport loop for rejecting heat.

In operation, refrigerant gas (e.g., HFC-134a) enters the compressor unit 210 as a low temperature, low-pressure vapor where it is compressed to a high pressure and temperature such that it will condense at ambient temperatures. From the compressor unit 210, the refrigerant travels to the condenser unit 220 where heat is rejected (i.e., the ambient air is cooled) and the refrigerant is condensed to a high-pressure liquid. A hot gas bypass valve 260 (e.g., a solenoid-controlled valve) couples a refrigerant outlet of the compressor unit 210 to an inlet of the evaporator unit 230. From the condenser unit 220, the now-liquid refrigerant travels through the filter/drier unit 270 where moisture and solid contaminants are removed from the refrigerant. Next, the refrigerant travels through a solenoid valve 280, which meters refrigerant flow to the proper rate and pressure. Refrigerant exiting the solenoid valve 280 enters the expansion valve 250 and is dropped to a saturation temperature corresponding to the user-selected air temperature set-point. The expansion valve 250 may be, for example, a block-type expansion valve with an internal sensing bulb. From the expansion valve 250, the refrigerant enters the evaporator unit 230 as a mixture of liquid and vapor. The liquid in the refrigerant mixture absorbs the heat from the warmer air returning from the inner cavity 130 via return 136 and becomes completely vaporized as it exits the evaporator heat exchanger. Heat absorbed in the evaporator unit 230 is rejected to ambient cabin air via an exhaust (e.g., configured on a rear side of the housing 110) by the motor-driven fan of the condenser unit 220. The motor-driven fan of the condenser unit 220 also creates a negative pressure on the inlet side of the condenser unit 220 thus drawing in ambient air through the air inlet 140. The airflow created by this fan carries the heat out the exhaust and into an outlet duct that may be provided in the galley.

The temperature of airflow through the refrigeration system 200 is monitored in various locations by a first plurality of sensors. Furthermore, the pressure and temperature of the refrigerant through the refrigeration system 200 is monitored in various locations by a second plurality of sensors. As shown in FIG. 2, the plurality of sensors includes temperature sensors 310, 320, 330, 340, 350 and pressure sensors 360, 370. One or more of the temperature sensors 310, 320, 330, 340, 350 may be a thermistor, thermocouple or any suitable device known in the art for sensing temperature. Furthermore, one or more of the pressure sensors 360, 370 may be a pressure transducer or any suitable device known in the art for sensing fluid pressure. The return air temperature sensor 310 is configured proximate the return grill 136 in the insulated cavity 130. The supply air temperature sensor 320 is configured proximate the supply grill 134 in the insulated cavity 130. The inlet air temperature sensor 330 is configured proximate an inlet of the condenser unit 220 to detect the temperature of ambient air flowing through the air inlet 140. The exhaust air temperature sensor 340 is configured proximate an exhaust to detect the temperature of air flowing out of the refrigeration system 220. The suction temperature sensor 350 is configured to detect the temperature of low pressure refrigerant between the thermal expansion valve 250 and the compressor unit 210. The suction pressure sensor 360 is configured proximate the suction temperature sensor 350 to detect the pressure of low pressure refrigerant between the thermal expansion valve 250 and the compressor unit 210. The discharge pressure sensor 370 is configured proximate to detect pressure of refrigerant flowing between an outlet of the condenser unit 220 and the filter drier unit 270. Furthermore, the discharge pressure sensor 370 may be configured proximate a high pressure cutout switch 240. Indeed, the foregoing-described plurality of sensor may be configured otherwise, for example, provided with fewer or additional temperature sensor and/or pressure sensors, or the plurality of sensors may be arranged to sense pressure and/or temperature in other locations within the refrigeration system 200.

Figure 3:
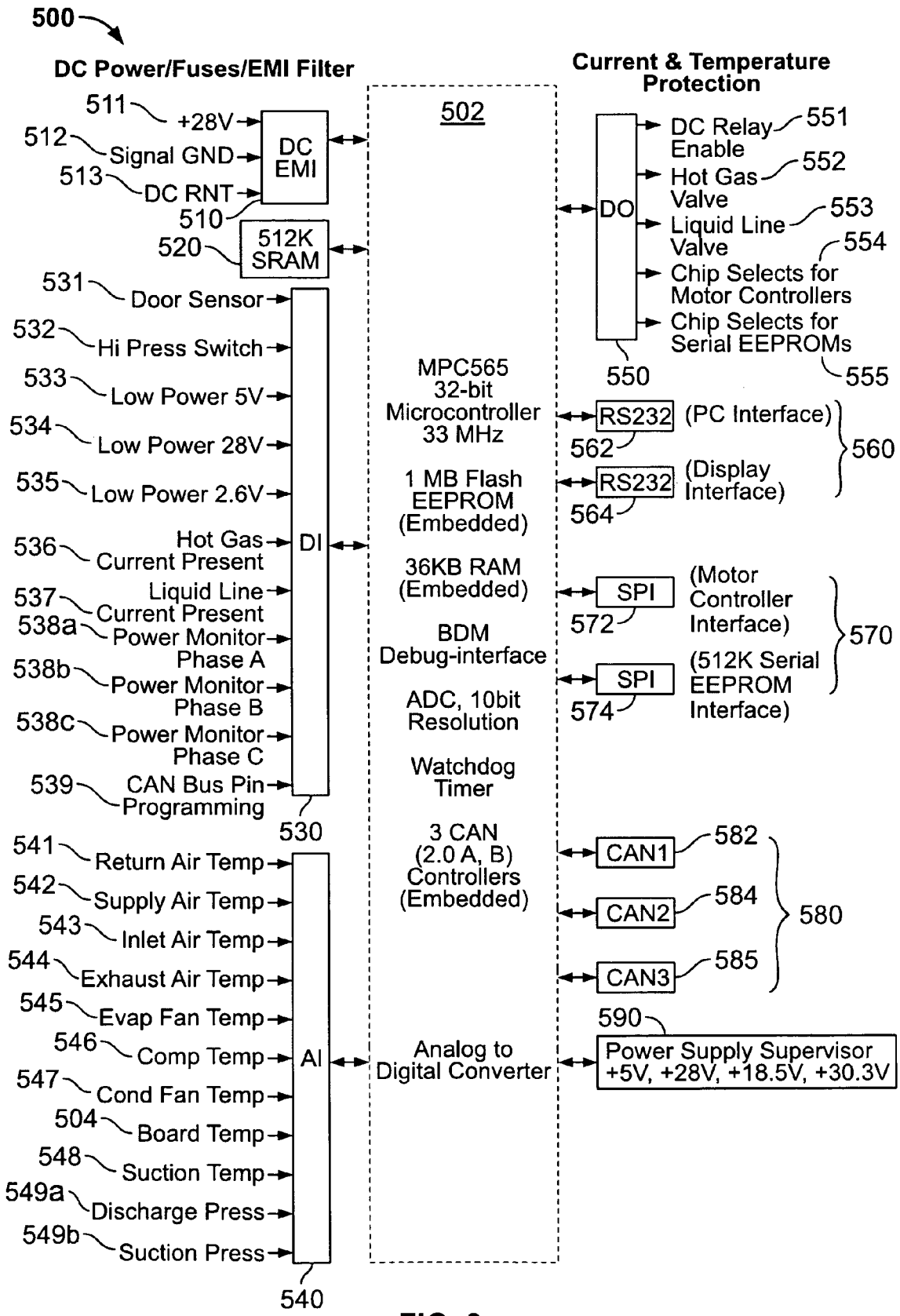
FIG. 3 is a block diagram illustrating an example controller for the embodiment of FIGS. 1 and 2.

Turning now to FIG. 3, an example controller is provided for controlling operation of the refrigeration system 200 of refrigeration unit 100. Additionally, as will be described hereinafter in further detail, the controller dynamically logs historical sensor data according to an occurrence of an event (e.g., fault, warning, etc.) to provide a diagnostic method for the refrigeration unit 100. As shown in FIG. 3, the controller 500 includes a processor 502. As can be appreciated, the processor 502 may be various devices known in the art such as a microprocessor, microcontroller, DSP, PLC, FPGA, state machine or the like. However, in some embodiments of the controller 500 it is advantageous for the processor 502 to be an integrated circuit (IC) microcontroller or microprocessor. Although the controller 500 is illustrated in FIG. 3 as including the 32-bit, 33 MHz MPC565 microcontroller that is available from Freescale Semiconductor, Inc., the processor 502 may be other suitable ICs. The processor 502 executes algorithms, software or firmware for processing a plurality of inputs (e.g., signals from the plurality of sensors of the refrigeration system 200, and user inputs from the user interface 150) and effecting a plurality of, for example, control and informational outputs relative to the plurality of inputs. Furthermore, in providing the diagnostic method for the refrigeration unit 100, the controller 500 determines an occurrence of an event according to the plurality of inputs and dynamically (i.e., at variable or non-fixed intervals or rates) logs historical data relative to an event occurrence.

The controller 500 includes a plurality of modules that are in communication with the processor 502. As shown, the plurality of modules includes a power input module 510, a memory module 520, a digital input module 530, an analog input module 540, an output module 550, a first communication module 560, a second communication module 570, a network communication module 580 and a power supply input supervisor module 590. The power input module 510 provides DC power, power protection and EMI filtering to the controller 500. 28V DC power input 511, signal ground input 512, and DC return input 513 interface with the power input module 510. The memory module 520 provides data storage for the controller 500. As shown, the memory module 520 is a 512K SRAM, but may be other types and sizes of memory. Additionally, although the memory module 520 is illustrated as being separate from the processor 502, the memory module 520 may alternatively be integral with (i.e., on-board) the processor 502.

The digital input module 530 receives and aggregates a plurality of digital input signals. As shown, the digital input module 530 interfaces with a door sensor input 531 (indicates that the door 120, FIG. 1 is not properly closed), a high pressure switch input 532 (indicates that the high pressure cutout switch 240, FIG. 2 detects a high pressure condition), a low power 5V input 533, a low power 28V input 534, a low power 2.6V input 535, a hot gas current present input 536 (indicates a current being supplied to the solenoid of hot gas bypass valve 260, FIG. 2), a liquid line current present input 537 (indicates a current being supplied to the solenoid of liquid line solenoid valve 280, FIG. 2), power monitor phase A, B and C inputs 538*a*, 538*b*, 538*c* (indicating a loss of phase), respectively, and a bus pin programming input 539.

The analog input module 540 receives and aggregates a plurality of analog input signals, providing the analog input signals to an A/D converter of the processor 502. As shown, the analog input module 540 interfaces with a return air temperature input 541, a supply air temperature input 542, an inlet air temperature input 543, an exhaust air temperature input 544, an evaporator unit fan motor (stator) temperature input 545, a compressor unit motor (stator) temperature input 546, a condenser unit fan motor (stator) temperature input 547, a controller board temperature input 504, a refrigerant suction temperature input 548, a refrigerant discharge pressure input 549*a* and a refrigerant suction pressure input 549*b*. As can be appreciated, the inputs 541-549 generally correspond with the temperature and pressure sensors 310-370 (FIG. 2).

As further shown in FIG. 3, the output module 550 provides a discrete control interface between the processor 502 and remote components, for example, relays, actuators (e.g., solenoid switches), etc. of the refrigeration system 200 for current and temperature protection. As illustrated, the output module 550 provides digital or discrete output control signals including DC relay enable output 551 (enables VDC bust to motor controllers), hot gas valve open/close output 552 (controls the state of the hot gas bypass valve 260, FIG. 2), liquid line valve open/close 553 (controls the state of the liquid line valve 280, FIG. 2), chip selects for (compressor, condenser, evaporator) motor controllers 554 (selects the motor controller module with which to communicate) and chip selects for serial EEPROMs 555 (selects the correct memory module for writing data entries to the history log data structure). The first communication module 560 as shown is an RS232 communication interface providing asynchronous serial communication. Communications between the processor 502 and an external personal computer (PC) is provided by PC interface 562 for the purposes of, for example, programming the controller 500, refrigeration system 200 diagnostics, debugging of the controller 500, and exercising various modules or subsystems of the refrigeration system 200 (e.g., the compressor unit 210, the condenser unit 220, the evaporator unit 230, etc.). Furthermore, communications between the processor 502 and a user interface including a display (e.g., the display 154 of the user interface 150, FIG. 1 or a "dumb" terminal) is provided by display interface 564 for the purposes of, for example, displaying data entries of a history log data structure, changing the temperature set-point, activating the one or more indicators 156 (FIG. 1), etc. The second communication module 570 as shown is a serial peripheral interface (SPI) providing communications between the processor 502 (being the master) and various (slave) external devices. Control and feedback communications with one or more motor controllers (e.g., PWM modules), which control the operation of the compressor unit motor, condenser unit motor, and evaporator unit motor of the refrigeration system 200, is provided by motor controller interface 572 for controlling motor speed and/or direction. Furthermore, communications between the processor 502 and one or more external memory modules (e.g., three 32K EEPROMs) is provided by interface 574 for writing and retrieving data entries of the history log data structure.

Although the present exemplary refrigeration unit 100 is a stand-alone unit requiring only a power connection, the controller 500 may also include a network communication module 580 so that the processor 502 may communicate with other vehicle subsystems, LRUs and the like via a communication bus or network. The controller 500 may be integral with the refrigeration unit 100 (e.g., disposed within the housing 110), however, the controller 500 may alternatively be configured outside the housing 110 distal the refrigeration unit 100 and in communication therewith via a wired or wireless link. As shown, the network communication module 580 is configured to interface the processor 502 with a bus or network using CAN protocol, but alternatively the network communication module 580 may be configured to interface the processor 502 with a bus or network using LIN, J1850, TCP/IP or other communication protocols known in the art. Power supply supervisor module 590 is in communication with the processor 502 and provides one or more of voltage, current and power monitoring for the refrigeration unit 100.

Operation of the Refrigeration Unit

During operation of the refrigeration unit 100, a user determines the temperature of the insulated cavity 130 by selecting one of seven predetermined operating modes shown in Table 1. During a "rapid pulldown mode" for fast chilling of beverages such as soft drinks and wine, it is desired to move the air through the insulated cavity 130 rapidly and also to distribute the cold air equally around each container. As can be appreciated, the present refrigeration unit 100 under control of controller 500 is operative to improve airflow distribution for temperature equalization purposes by means of reversing the rotational direction of one or more motors (e.g., the motor of evaporator unit 230). This ensures, for example, that the top of the containers will see the same temperature as the bottom of the containers during the cooling process. This reversible fan motor direction mixes the air within the insulated cavity 130 allowing for more uniform distribution of cold air.

Furthermore, in the present refrigeration unit 100, by reversing the rotational direction of one or more of the fan motors, airflow from the fan allows the warm air to enter the evaporator unit 230 for duration of time, thereby enabling a defrost cycle without the need of a standard (i.e., heating) defrost cycle. Additionally, if a standard (i.e., heating) defrost cycle is needed, reversing the fan motor of evaporator unit 230 will result in a shorter duration defrost time with less power consumption.

TABLE 1

| Operating Mode | Temperature set-point |
|---|---|
| Beverage Chiller | 16° C. (61° F.) |
| Beverage Chiller | 12° C. (54° F.) |
| Beverage Chiller | 9° C. (48° F.) |
| Refrigerator | 7° C. (45° F.) |
| Refrigerator | 4° C. (39° F.) |
| Freezer | −12° C. (10° F.) |
| Freezer | −18° C. (0° F.) |

The controller 500 attempts to maintain the temperature within the insulated cavity 130 within about +/−2° C. of the selected temperature set point by independently controlling variable motor speeds of the evaporator unit 230, condenser unit 220 and compressor unit 210. If the controller 500 is unable to control the refrigeration system 200 to maintain the temperature within the insulated cavity 130 within about +/−2° C. of the selected temperature set point, the controller 500 may activate or otherwise provide a warning or alert. For example, the controller 500 may activate the one or more indicators 156 (FIG. 1), which may be embodied as one or more colored lights, according to Table 2.

TABLE 2

| Temp Warning | Time | Threshold | Temperature |
|---|---|---|---|
| Long Term Warning | 60 mins | 75% | Greater than 4° C. (7.2° F.) above target temperature |
| Short Term Warning | 15 mins | 75% | Greater than 15° C. (27° F.) above target temperature |
| Temp Warning Off | 15 mins | 75% | Actual temperature at or below target temperature |

Compressor Unit Control

The controller 500 monitors return air temperature using return air temperature sensor 310 and adjusts the motor speed of the compressor unit 210 using a PID equation. The motor of the compressor unit 210 is controlled by controller 500 so that it has a minimum speed of 40%. If the return air temperature sensor 310 has malfunctioned, then data from the supply air temperature sensor 320 may be used by the controller 500 to adjust the air temperature to correspond with selected temperature set-point. In the following tables, 100% compressor speed may be, for example, 3500 RPM.

The PID temperature control equation may be overridden if the discharge pressure measured by discharge pressure sensor 370 (FIG. 2) is above a predetermined pressure threshold, for example, 275 psi. In this instance, speed of the motor of compressor unit 210 may be reduced proportionately according to the sensed discharge pressure amount above the threshold discharge pressure. In order to reduce instances of high inrush current, the motor of compressor unit 210 may be started either with no delay, or started after a one-second delay. For example, the delay time shall be determined pseudo-randomly by the processor 502 using the least significant bit of the ambient air temperature sensed by inlet air temperature sensor 330. The motor of compressor unit 210 may have a minimum 30 seconds between starts. In a freezer or pulldown mode, the hot gas bypass valve 260 (FIG. 2) may be opened approximately 5 seconds before each start of the compressor unit motor. Furthermore, in a freezer or pulldown mode, the hot gas bypass valve 260 may be closed approximately 5 seconds after each start of the compressor unit motor. After the compressor start logic, the hot gas valve 260 may be closed if the temperature sensed in the insulated cavity 130 (FIG. 1) is more than about 5° F. above the set-point temperature. The hot gas valve 260 may be open if the temperature sensed in the insulated cavity 130 is more than about 3° F. below the set-point temperature, except in freezer and pulldown modes, in which case the hot gas valve 260 may be closed. Moreover, the liquid line valve 280, in chiller mode only, may be closed if the temperature sensed in the insulated cavity 130 is more than about 7° F. below the set-point temperature, and shall be opened if the temperature is more than about 3° F. above the set-point temperature.

Evaporator Unit Control

The speed of the motor of the evaporator unit 230 may be controlled by controller 500 according to Table 3. In this table, 100% evaporator speed may be, for example, 8500 RPM. The motor of evaporator unit 230 may have a minimum 5 seconds between starts.

TABLE 3

| Set Point/Mode | Evaporator Fan Speed |
|---|---|
| Compressor Off | Off |
| Defrost Mode | Off |
| Door Not Locked for < 10 minutes | 40% |
| Door Not Locked for >= 10 minutes | Resume control of fan |
| Rapid Pulldown | 100% |
| Freezer | 100% |
| Temperature Control Mode | unchanged |
| (Return Air temp - Set point) > 5.6° C. (10° F.) | 60% |
| 4.4° C. (10° F.) >= (Return Air temp – Set point) > = 4.4° C. (8° F.) | |
| (Return Air temp - Set point) < 4.4° C. (8° F.) | |
| Refrigerator/Chiller | 100% |
| Temperature Control Mode | unchanged |
| (Return Air Temp - Supply Air Temp) > 3.3° C. (6° F.) | 60% |
| 3.3° C. (6° F.) >= (Return Air temp - Supply Air Temp) >= 2.2° C. (4° F.) | |
| (Return Air Temp - Supply Air Temp) < 2.2° C. (4° F.) | |
| Default if either supply or return air temperature sensor is malfunctioning | 70% |

Condenser Unit Control

The speed of the motor of condenser unit 220 may be controlled by the controller 500 according to Table 4. In this table, 100% condenser speed may be, for example, 8500 RPM. The motor of condenser unit 220 may remain on for 2 minutes after the motor of compressor unit 210 has stopped.

TABLE 4

| Ambient Temperature | Condenser Fan Speed |
|---|---|
| Above 119° F. (Above 48.3° C.) | 100% |
| 115° F. to 119° F. (46.1° C. to 48.3° C.) | Unchanged |
| 85° F. to 114° F. (29.4° C. to 45.6° C.) | 90% |
| 80° F. to 84° F. (26.7° C. to 28.9° C.) | Unchanged |
| 50° F. to 79° F. (10° C. to 26.1° C.) | 80% |
| 45° F. to 49° F. (7.2° C. to 9.4° C.) | Unchanged |
| Below 45° F. (Below 7.2° C.) | 70% |
| Default if ambient temperature sensor has malfunctioned | 90% |

History Data Logging

The controller 500 writes sensor data and other inputs to a history log data structure for retrieval and use in diagnosing faults, malfunction, human error, etc. relative to the operation of the refrigeration unit 100. An example history log data structure may include a header that is written by the controller 500 at each initialization/power-on of the refrigeration unit 100. As shown in Table 5, the header may provide general identification of hardware and software versions, lifetime status of the refrigeration unit 100, etc.

TABLE 5

| Element Name | Description |
|---|---|
| Entry Type | Identifies the data as a header entry or a type of log entry: Warning, Fault, or Information |
| Part Number | Binary Part Number (e.g. 0x0600) |
| Dash Number | Binary dash number. |
| Build Number | Build number for the project |
| App Rev Letter | ASCII revision letter for application code |
| Boot Rev Letter | ASCII revision letter for boot code |
| Modification Month | Modification month (binary) |
| Modification Day | Modification day (binary) |

TABLE 5-continued

| Element Name | Description |
|---|---|
| Modification Year | Modification year (binary) |
| CAN Address | Controller address for network communication |
| Current Index | The index for the next history log entry |
| Auto Start | Stores the status for autostart on power up |
| Number of Starts | Number of Starts |
| Hours Run | Lifetime number of hours powered on |
| Compressor Hours | Lifetime number of hours the compressor has run |
| Evaporator Fan Hours | Lifetime number of hours the evaporator fan has run |
| Condenser Fan Hours | Lifetime number of hours the condenser fan has run |
| Number of Defrosts | Lifetime number of defrosts |
| Number of Failures | Lifetime number of failures |

As shown in Table 6, each data entry includes data from the plurality of sensors of the refrigeration system 200. Thus, each data entry that is written by the controller 500 to the history log data structure includes information indicative of instantaneous operation of the refrigeration unit 100 to help discriminate between real problems (e.g., faults, hardware failure, etc.) or user-error induced problems.

TABLE 6

| Element Name | Description |
|---|---|
| Entry Type | Identifies the data as a header entry or a type of log entry: Warning, Fault, or Information |
| Date Time | Time Since Power On |
| Start Number | Start number used to group entries together |
| Mode | Current mode of operation |
| Set Point | Current temperature selection |
| Supply Temp | Supply air temp |
| Return Temp | Return air temp |
| Inlet Air Temp | Condenser air temperature at the inlet |
| Exhaust Air Temp | Condenser air temperature at the outlet |
| Evaporator Fan Stator Temp | Temperature of the evaporator fan |
| Condenser Fan Stator Temp | Temperature of the condenser fan |
| Compressor Stator Temp | Temperature of the compressor |
| Discharge Pressure | Discharge pressure in psig |
| Suction Temperature | Temperature of the refrigerant |
| PC Board Temperature | Temperature of the PC Board |
| Input Discretes | Door Switch |
| | High Pressure Cutout Switch |
| | Hot Gas Bypass Valve current present |
| | Liquid Line Valve current present |
| | Power Monitor Phases A, B, and C |
| Output Discretes | Hot Gas Bypass Valve |
| | Liquid Line Solenoid Valve |
| | On LED |
| | Temp Warning LED |
| | Fault LED |
| Evaporator Fan speed | The speed of the evaporator fan |
| Condenser Fan speed | The speed of the condenser fan |
| Compressor Fan speed | The speed of the compressor |
| Information Code | Active information or error code |

The controller 500 is operative to dynamically vary its data logging between at least two logging modes. That is, the interval or rate at which the controller 500 writes data entries to the history log data structure may change to suitably capture operating data and parameters of the refrigeration unit 100 for the purposes of, for example, debugging and diagnosing irregular operation. For example, data entries may be written by the controller 500 to the data structure: 1) in a normal data-logging mode every 3 minutes during normal operation; 2) in a standby data-logging mode every 15 minutes while not performing cooling operations (including after shutdown); 3) in a warning data-logging mode every 1 minute while a warning event is detected; 4) in an informational data-logging mode for logging an informational event substantially simultaneously with its occurrence; and 5) in a fault data-logging mode for logging a fault event substantially simultaneously with its occurrence. Furthermore, the controller 500, in some embodiments, may implement a rollover algorithm in which the oldest data entries are overwritten by new data entries using a "circular" list of entries.

Determination of occurrences of the events (i.e., warning events, fault events and informational events) is performed by the controller 500 relative to the plurality of received inputs (i.e., sensor data inputs and user inputs). Example warning events are defined in Table 7, example informational events are defined in Table 8 and example fault events are defined in Table 9. Warning events are generally occurrences of sensed temperatures and pressures being substantially different from predetermined (normal or expected) temperatures and pressures. Informational events generally occur relative to user-actuated state changes (e.g., mode change, temperature set-point change, door opening, etc.) of the refrigeration unit 100. Fault events may be one-time, recurring or pervasive instances of miscommunication with sensors and other components of the refrigeration system 200. Fault events occur as a function of the controller 500 monitoring system sensors and detecting when those sensors indicate a problem of some variety. The algorithms of determining fault events are designed to eliminate false alarms and erroneous non-operation by a series of confirmation checks over time, and intelligent actions (e.g., restarting) initiated by the controller 500.

TABLE 7

| Warning Event Description | Set When . . . |
|---|---|
| Supply Air > Return Air | The supply air temperature is greater than the return air temperature. |
| High Inlet Air Temp | The Inlet (Ambient) air temperature is greater than 110° F. (43.3° C.) |
| High Exhaust Air Temp | The Outlet air temperature is greater than 140° F. (60° C.) |
| High Evaporator Fan Stator | The Evaporator Fan Stator temperature is greater than 200° F. (93° C.) |
| High Condenser Fan Stator | The Condenser Fan Stator temperature is greater than 200° F. (93° C.) |
| High Compressor Stator | The Compressor Stator temperature is greater than 275° F. (135° C.) |
| High Discharge Pressure | The Discharge pressure is greater than 275 Psig |
| Low Discharge Pressure | The Discharge pressure is less than 40 psi, while the compressor is running |

TABLE 8

| Informational Event Description | Set When . . . |
|---|---|
| Door Open | The door is not closed properly. |
| Door Closed | The door is in the locked position. |
| Start Key Selected | The user has pressed the Start key. |
| Pause Key Selected | The user has pressed the Pause key. |
| Temperature Warning On | The Temperature Warning LED has been illuminated. |
| Temperature Warning Off | The Temperature Warning LED has been turned Off. |
| Mode Change | A mode change has occurred. |

TABLE 9

| Self-Protect Sensor | Fault Condition | Recovery |
|---|---|---|
| Evaporator Fan Temperature | Temp > 225° F. (107.2° C.) | Evap Fan = OFF<br>Cond Fan = OFF Comp = OFF |
| Condenser Fan Temperature | Temp > 225° F. (107.2° C.) | Evap Fan = OFF<br>Cond Fan = OFF<br>Comp = OFF<br>(highest priority) |
| Compressor Temperature | Temp > 300° F. (149° C.) | Evap Fan = OFF<br>Cond Fan = ON Comp = OFF |
| High Discharge Pressure | Pressure > 325 psig | Evap Fan = OFF<br>Cond Fan = ON Comp = OFF |
| Low Discharge Pressure | Pressure < 15 psig and Ambient > 40° F. (4.4° C.) and<br>Comp Temp > 40° F. (4.4° C.) | Evap Fan = OFF<br>Cond Fan = ON<br>Comp = OFF |
| High Pressure Cutout Switch | True<br>(discrete) | Evap Fan = OFF<br>Cond Fan = OFF<br>Comp = OFF |
| Supply Air Sensor Failure | N/A | N/A |
| Return Air Sensor Failure | N/A | N/A |
| Return Air and Supply Air Sensor Failure | N/A | N/A |
| Suction Temp Sensor Failure | N/A | N/A |
| High Inlet Air Temperature (Ambient) | Temp > 130° F.<br>(54.4° C.) | Evap Fan = OFF<br>Cond Fan = ON<br>Comp = OFF |
| Low Inlet Air Temperature (Ambient) | Temp < 39° F.<br>(4° C.) | Evap Fan = OFF<br>Cond Fan = ON<br>Comp = OFF |
| High Exhaust Air Temperature | Temp > 158° F.<br>(70° C.) | Evap Fan = OFF<br>Cond Fan = ON<br>Comp = OFF |
| High PC Board Temperature | Temp > 176° F.<br>(80° C.) | Evap Fan = OFF<br>Cond Fan = OFF<br>Comp = OFF |

TABLE 9-continued

| Self-Protect Sensor | Fault Condition | Recovery |
|---|---|---|
| Low PC Board Temperature | Temp < 10° F. (−12° C.) | Evap Fan = OFF<br>Cond Fan = OFF<br>Comp = OFF |
| Compressor MC Error | True | Fault Clear |
| Evaporator MC Error | True | Fault Clear |
| Condenser MC Error | True | Fault Clear |
| Hot Gas Bypass Current Sense | Does not match Hot Gas output command | Evap Fan = OFF<br>Cond Fan = OFF<br>Comp = OFF |
| Liquid Line Current Sense | Does not match Liquid Line output command | Evap Fan = OFF<br>Cond Fan = OFF<br>Comp = OFF |
| 3-Phase A/C Phase Error | Any 1 phase missing | Evap Fan = OFF<br>Cond Fan = OFF Comp = OFF<br>Toggle DC Relay Enable discrete |
| Low Power 28 V | True | Evap Fan = OFF<br>Cond Fan = OFF<br>Comp = OFF |
| Low Power 5 V | True | Evap Fan = OFF<br>Cond Fan = OFF<br>Comp = OFF |
| Low Power 2.6 V | True | Evap Fan = OFF<br>Cond Fan = OFF<br>Comp = OFF |
| DC Fail Latch | Any of the 3 DC Fail Latches are TRUE | Evap Fan = OFF<br>Cond Fan = OFF Comp = OFF |
| Evaporator Fan Start Failure | Fan RPMs indicate that the fan did not start | Restart evaporator fan |
| Condenser Fan Start Failure | Fan RPMs indicate that the fan did not start | Restart condenser fan |
| Compressor Start Failure | Compressor RPMs indicate that the compressor did not start | Restart compressor |

Figure 4:
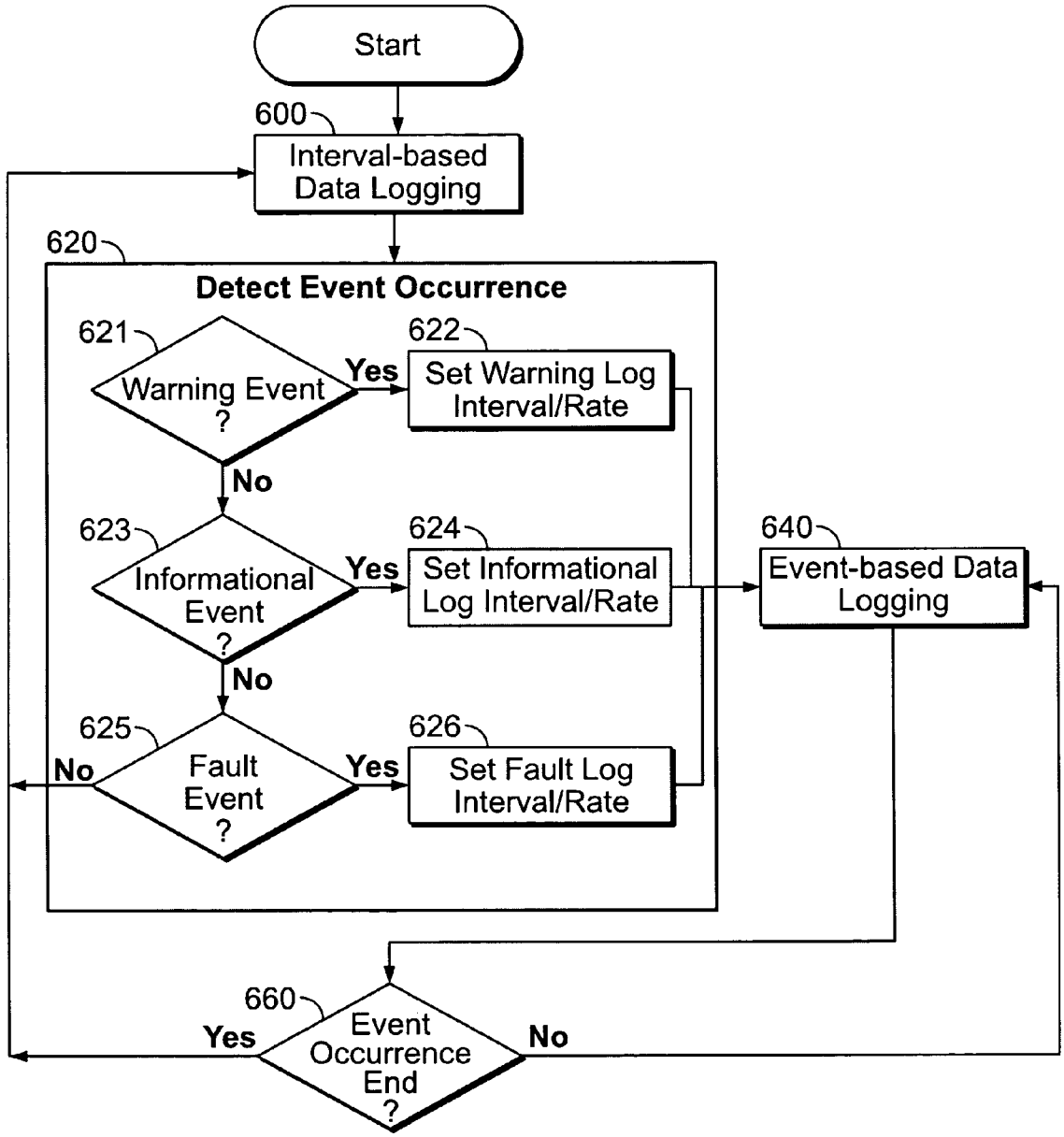
FIG. 4 is a flowchart illustrating an example diagnostic method for a refrigeration unit.

Referring now to FIG. 4, a diagnostic method is provided for a refrigeration unit in view of the foregoing. The refrigeration unit comprises a controller and a refrigeration system including a plurality of sensors configured to detect an instant operating state of the refrigeration system. As described above, the controller substantially continuously processes data from the plurality of sensors in addition to user input signals, etc. to determine the occurrence of an event. As can be appreciated from FIG. 4, in block 600 the processor may initially store or otherwise write data entries to a history log data structure in a first data-logging mode, for example, at a first (e.g., normal) interval or rate. While the controller is processing data, the controller in block 620 detects or otherwise determines an occurrence of an event upon and/or during which the controller stores or otherwise writes data entries to the history log data structure in a second data-logging mode, for example, instantaneously upon event occurrence or at an interval or rate different from the first interval or rate. Furthermore, in some embodiments, the controller may determine the type of event to select a suitable data writing or storage interval or rate. As shown, block 620 includes block 621 for determining an occurrence of a warning event (as described above) and corresponding block 622 for setting a warning event log interval/rate. Furthermore, block 620 includes block 623 for determining an occurrence of a informational event (as described above) and corresponding block 624 for setting an informational event log interval/rate. Additionally, block 620 includes block 625 for determining an occurrence of a fault event (as described above) and corresponding block 626 for setting an informational event log interval/rate. Although block 620 is illustrated as including blocks 621-626, fewer or additional event-determining and interval/rate-setting blocks may be provided. As can be appreciated, it is not necessary for an interval/rate of a logging mode to define recurring data-logging, but rather, the interval/rate may define a one-time writing or storing of data substantially simultaneous with detecting the event occurrence.

After selecting a logging mode according to the event occurrence that was determined by the controller, the controller begins to log data entries with an appropriate (event-based) data-logging rate/interval in block 640. Next, the controller in block 660 determines if the event has ended or persists. If the event is persisting, the controller continues to log data entries in block 640 in its currently-set data-logging mode with the event-based rate/interval. However, if the controller determines that the event has ended, the controller again returns to its first data-logging mode and logs the data entries to the history log data structure at the first interval/rate. In this exemplary method, it should be appreciated that additional historical data is collected during events to thereby facilitate diagnostics and debugging of the refrigeration unit.

All references, including publications, patent applications, and patents, cited herein are hereby incorporated by reference to the same extent as if each reference were individually and specifically indicated to be incorporated by reference and were set forth in its entirety herein.

The use of the terms “a” and “an” and “the” and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A refrigeration unit comprising:

a housing including an insulated cavity configured to store food and beverages;

a vapor cycle system disposed in the housing, the vapor cycle system operative to cool the food and beverages in the insulated cavity;

a plurality of sensors disposed in the housing, the plurality of sensors in communication with the vapor cycle system and operative to output data relative to the vapor cycle system; and a controller comprising:

an input module that receives, the data from the plurality of sensors, a processor communicatively coupled with the input module and operative to process the data from the plurality of sensors to determine an occurrence of an event related to the data from the plurality of sensors and effect a plurality of control and informational outputs relative to the data from the plurality of sensors, an output module communicatively coupled with the processor and operative to output control signals to the vapor cycle system as effected by the processor, and a memory module communicatively coupled with the processor, the memory module including a history log data structure to which the data from the plurality of sensors is logged as effected by the processor according to a first data-logging mode, and to which the data from the plurality of sensors is logged as effected by the processor according to a second data-logging mode upon occurrence of the event related to the data from the plurality of sensors as determined by the processor, wherein the first data-logging mode comprises the controller logging the data from the plurality of sensors at a first data-logging rate and the second data-logging mode comprises the controller logging the data from the plurality of sensors at a second data-logging rate different from the first data-logging rate.

2. The refrigeration unit of claim 1 wherein the second data-logging rate comprises a one-time logging of the data substantially simultaneously with the occurrence of the event.

3. The refrigeration unit of claim 1 wherein the vapor cycle system comprises:

a compressor unit;

a condenser unit including a condenser fan; and an evaporator unit including an evaporator fan, wherein the controller is operative to reverse a direction of the evaporator fan to defrost the vapor cycle system.

4. The refrigeration unit of claim 3 wherein the plurality of sensors comprises:

at least one temperature sensor disposed in an airflow of at least one of the condenser fan and the evaporator fan; and at least one pressure sensor.

5. The refrigeration unit of claim 4 wherein the at least one temperature sensor comprises:

an intake air temperature sensor;

an exhaust air temperature sensor;

a supply air temperature sensor at an outlet of the evaporator unit; and a return air temperature sensor at an inlet of the evaporator unit.

6. The refrigeration unit of claim 4 wherein the at least one temperature sensor comprises a thermistor.

7. The refrigeration unit of claim 4 wherein the at least one pressure sensor comprises:

a first pressure transducer configured at a refrigerant inlet of the compressor; and a second pressure transducer configured at a refrigerant outlet of the condenser unit.

8. The refrigeration unit of claim 1 further comprising a user interface in communication with the controller, the user interface operative to set a temperature set point for the insulated cavity.

9. The refrigeration unit of claim 8 wherein the user interface further comprises a warning device, the warning device operative to output an alert when the controller detects a difference between a temperature sensed in the insulated cavity and the temperature set point.

10. A refrigeration line replaceable unit (LRU) for an aircraft galley, the refrigeration LRU comprising:

a housing including an insulated cavity configured to store food and beverages;

a door coupled with the housing, the door operative to move between an open orientation for accessing the food and beverages and a closed orientation for sealing the food and beverages in the insulated cavity;

a door sensor operative to detect the open orientation and output a door signal relative to the open orientation;

a vapor cycle system operative to cool the food and beverages in the insulated cavity;

a plurality of sensors in communication with the vapor cycle system, the plurality of sensors operative to output at least temperature and pressure data relative to the vapor cycle system; and a controller comprising:

an input module that receives the door signal from the door sensor and the at least temperature and pressure data from the plurality of sensors in communication with the vapor cycle system, a processor communicatively coupled with the input module and operative to determine an occurrence of an event related to the door signal and the at least temperature and pressure data and effect a plurality of control and informational outputs relative to the door signal and the at least temperature and pressure data, an output module communicatively coupled with the processor and operative to output control signals to the vapor cycle system as effected by the processor, and a memory module communicatively coupled with the processor, the memory module including a history log data structure to which the controller logs the at least temperature and pressure data at a first data-logging rate, and to which the controller logs the at least temperature and pressure data at a second data-logging rate upon occurrence of the event related to the door signal and the at least temperature and pressure data as determined by the processor, wherein the second data-logging rate is different from the first data-logging rate.

11. The refrigeration LRU of claim 10 wherein the vapor cycle system comprises:

a compressor unit including a compressor motor and a compressor sensor, the compressor sensor operative to detect a rotational speed of the compressor motor;

a condenser unit including a condenser motor and a condenser sensor, the condenser sensor operative to detect at least one of a rotational direction and a rotational speed of the condenser motor; and an evaporator unit including an evaporator motor and an evaporator sensor, the evaporator sensor operative to detect at least one of a rotational direction and a rotational speed of the evaporator motor, and wherein the controller is operative to reverse the rotational direction of the evaporator motor to defrost the vapor cycle system.

12. The refrigeration LRU of claim 10 further comprising a user interface in communication with the controller, the user interface operative to set a temperature set point for the insulated cavity.

13. The refrigeration LRU of claim 12 wherein the user interface further comprises a warning device, the warning device operative to an alert when the controller detects a difference between a temperature sensed in the insulated cavity and the temperature set point.

14. The refrigeration LRU of claim 11 wherein the plurality of sensors comprises:

an intake air temperature sensor;

an exhaust air temperature sensor;

a supply air temperature sensor at an outlet of the evaporator unit; and a return air temperature sensor at an inlet of the evaporator unit.

15. The refrigeration unit of claim 1 wherein the event is selected from the group consisting of a warning event, a fault event, and an informational event.

16. The refrigeration unit of claim 1 wherein while the event persists, the controller continues to log the data to the history log data structure at the second data-logging rate, and after the event ends, the controller returns to logging the data to the history log data structure at the first data-logging rate.

17. The refrigeration unit of claim 1 wherein the first data-logging rate is a fixed rate at which data entries of the data from the plurality of sensors are written to the history log data structure and the second data-logging rate is a different rate at which data entries of the data from the plurality of sensors are written to the history log data structure compared to the fixed first data-logging rate.

18. The refrigeration LRU of claim 10 wherein the event is selected from the group consisting of a warning event, a fault event, and an informational event.

19. The refrigeration LRU of claim 10 wherein while the event persists, the controller continues to log the at least temperature and pressure data to the history log data structure at the second data-logging rate, and after the event ends, the controller returns to logging the at least temperature and pressure data to the history log data structure at the first data-logging rate.

20. The refrigeration LRU of claim 10 wherein the first data-logging rate is a fixed rate at which data entries of the at least temperature and pressure data from the plurality of sensors are written to the history log data structure and the second data-logging rate is a different rate at which data entries of the at least temperature and pressure data from the plurality of sensors are written to the history log data structure compared to the fixed first data-logging rate.

* * * * *